US009610000B2

(12) United States Patent
Rehm et al.

(10) Patent No.: US 9,610,000 B2
(45) Date of Patent: Apr. 4, 2017

(54) DISHWASHER WITH AT LEAST ONE LIGHT SOURCE WHICH IS CONTROLLED DEPENDENT ON MOVEMENT POSITIONS OF A RECEIVING BASKET

(71) Applicants: Karlheinz Rehm, Dischingen (DE); Michael Georg Rosenbauer, Reimlingen (DE); Robert Sachon, München (DE); Carsten Stelzer, Wuppertal (DE)

(72) Inventors: Karlheinz Rehm, Dischingen (DE); Michael Georg Rosenbauer, Reimlingen (DE); Robert Sachon, München (DE); Carsten Stelzer, Wuppertal (DE)

(73) Assignee: BSH Hausgeräte GmbH, Munich (DE)

( * ) Notice: Subject to any disclaimer, the term of this patent is extended or adjusted under 35 U.S.C. 154(b) by 232 days.

(21) Appl. No.: 14/351,147

(22) PCT Filed: Oct. 11, 2012

(86) PCT No.: PCT/EP2012/070158

§ 371 (c)(1),
(2) Date: Apr. 11, 2014

(87) PCT Pub. No.: WO2013/053823

PCT Pub. Date: Apr. 18, 2013

(65) Prior Publication Data

US 2014/0230865 A1 Aug. 21, 2014

(30) Foreign Application Priority Data

Oct. 13, 2011 (DE) ..... 10 2011 084 460

(51) Int. Cl.
*A47L 15/00* (2006.01)
*A47L 15/42* (2006.01)
*A47L 15/50* (2006.01)

(52) U.S. Cl.
CPC ..... *A47L 15/4293* (2013.01); *A47L 15/0049* (2013.01); *A47L 15/4257* (2013.01);
(Continued)

(58) Field of Classification Search
CPC ..... A47L 15/0049; A47L 15/4257; A47L 15/4293; A47L 15/50; A47L 15/507; A47L 2401/34; A47L 2501/26
(Continued)

(56) References Cited

U.S. PATENT DOCUMENTS 5,257,171 A 10/1993 Hara
2006/0138916 A1 6/2006 Kordon
(Continued)

FOREIGN PATENT DOCUMENTS

DE 10042428 A1 3/2002
EP 1192893 B1 11/2004
(Continued)

OTHER PUBLICATIONS

Report of Examination CN 201280050108.0 dated Sep. 2, 2015.
(Continued)

*Primary Examiner* — Michael Barr
*Assistant Examiner* — Levon J Shahinian
(74) *Attorney, Agent, or Firm* — Michael E. Tschupp; Andre Pallapies

(57) ABSTRACT

A dishwasher includes a dishwashing compartment having a loading opening which can be closed by a door configured. At least one washware basket is provided for movement out of and into the dishwashing compartment, with at least one movement position of the washware basket being recognized by a device. At least one light source is arranged in or on the dishwasher and controlled by a control device in dependence on the at least one movement position of the washware basket.

23 Claims, 5 Drawing Sheets

(52) U.S. Cl.
CPC ..... *A47L 15/50* (2013.01); *A47L 15/507* (2013.01); *A47L 2401/34* (2013.01); *A47L 2501/26* (2013.01)

(58) Field of Classification Search
USPC ..... 134/56 D, 57 D, 58 D, 113
See application file for complete search history.

(56) References Cited

U.S. PATENT DOCUMENTS

| | | | |
|---|---|---|---|
| 2008/0072937 | A1 | 3/2008 | Choi et al. |
| 2008/0099059 | A1 | 5/2008 | Baumgartner et al. |
| 2010/0126526 | A1 | 5/2010 | Poyner et al. |
| 2011/0149551 | A1* | 6/2011 | Camarillo Fernandez ..... F24C 15/02 362/92 |
| 2011/0215689 | A1 | 9/2011 | Wegener et al. |
| 2011/0248609 | A1 | 10/2011 | Hoepfl et al. |

FOREIGN PATENT DOCUMENTS

| | | | |
|---|---|---|---|
| EP | 1925250 | A1 | 5/2008 |
| JP | H1119019 | A | 1/1999 |

OTHER PUBLICATIONS

International Search report PCT/EP2012/070158 dated Oct. 11, 2012.
Report of Examination DE 10 2011 084 460.0 dated Jul. 11, 2012.

* cited by examiner 4
6
1
13a
2
13a
13b
13b
36
34
27
31
VI
33
37, 13c
33
13c, 37
27
3
45
46

3
33
3
33
17
VIII
VIII 33
37, 13c
45
3
41

DISHWASHER WITH AT LEAST ONE LIGHT SOURCE WHICH IS CONTROLLED DEPENDENT ON MOVEMENT POSITIONS OF A RECEIVING BASKET

BACKGROUND OF THE INVENTION

The invention relates to a dishwasher, in particular domestic dishwasher, with a dishwashing compartment having an in particular frontal, loading opening, a door to close said loading opening and at least one washware basket which is movable out of and into the dishwashing compartment.

Dishwashers frequently have optical indicators, which are intended to facilitate operation, for example in that they request the effecting of certain actions, for example the replenishment of salt in a dishwasher salt receptacle. Such optical indicators can for example be provided on a panel on the door front, on the top edge of the door, on the internal wall of the door and/or in the dishwashing compartment. It is the object of the invention to propose a dishwasher of the type described in the introduction, which is improved in respect of the operation of at least one washware basket.

BRIEF SUMMARY OF THE INVENTION

This problem is solved in accordance with the invention in that the dishwasher comprises an in particular non-contacting device for the recognition of at least one movement position of the washware basket and a control device, which controls at least one light source arranged in and/or on the dishwasher, depending on the at least one movement position of the washware basket.

Such an embodiment opens up completely new possibilities for optically-based user support and user guidance, in particular user animation. The user can thus for example be made aware, by means of the illumination of a light source, that the washware basket has perhaps not been fully retracted into the dishwashing compartment after being loaded with washware. In this way it is possible to prevent the door striking the washware basket upon being closed and washware thereby being dislodged from its retainer and damaged. A similar situation also obtains upon withdrawing the washware basket, if this is pulled to the extreme end of its travel with excessive speed. Washware can be dislodged here too.

The proposed embodiment further offers the possibility of mapping and indicating the progress of the withdrawal and insertion of the washware basket by optical means.

The control device is expediently embodied in such a way that at least one parameter of the at least one light source can be controlled by means of the control device, in particular its illuminance, color, mode of illumination, time of activation and/or deactivation, and/or timing varied. A change in the respective spatial position of the respective washware basket can thereby be dynamically signaled or indicated by means of a change in at least one parameter of the one or more light sources. This improves user guidance. In particular the handling of the respective washware basket is thereby facilitated.

A parameter of a light source which can be controlled depending on the respective movement position of the washware basket is thus, for example, its operating status, i.e. in order to draw the user's attention to a particular movement position of the washware basket the light source can simply be switched on or illuminated. Furthermore an indication of the respective movement position of the washware basket can take place in that the illuminance or the color of a light source are changed. In the case of a color change the use of color filters is conceivable, or light sources provided which have means of illumination, such as LEDs, of different colors, wherein a certain means of illumination or—to create a mixture of colors—multiple means of illumination are activated.

If in particular a non-contacting device for the position detection of the respective washware basket is used, no extensive adaptation of the respective washware basket is required, so that washware baskets of conventional embodiment and mounting can continue to be used without modification. The non-contacting device for position detection can for example operate inductively or capacitively, and make use of corresponding sensors. In the case of one preferable embodiment a Hall sensor is employed, wherein at least one magnet which interacts with the aforementioned sensor is attached to the washware basket.

The at least one light source is expediently arranged outside the respective washware basket in and/or on the dishwasher and is variable depending on the at least one movement position of the washware basket.

The respective light source is in particular provided in the dishwashing compartment, preferably in and/or on its floor and/or its side walls, and/or in particular in and/or on that internal wall surface on the door which faces the interior of the dishwashing compartment in its final closed position.

It is therefore simple in a number of practical circumstances appropriately to illuminate or render visible the interior compartment of the dishwasher, including in particular the treatment area of the dishwasher, the internal wall surface of the door facing the treatment area when the door is in its final closure position, and other areas which are invisible to the user when viewed from the front in the final closure position of the door, i.e. they are concealed. In contrast to a dishwasher with a movable washware basket, which is equipped with a light source and would require complex linkage mechanisms to its electrical connection to an electrical power supply line, a stationary, i.e. fixed accommodation of the one or more light sources and their associated electrical connections is sufficient in the case of the inventive dishwasher.

In a particularly preferable embodiment it is provided that multiple light sources are present and that the control device is so embodied that it activates an increasing number of light sources with the increasing path of travel of the washware basket. In this way, if the light sources are preferably arranged in a row extending in the direction of movement of the washware basket, an optically changing strip light or lighting ribbon is created. The light sources can here be actuated by the control device in such a way that the number of illuminated light sources increases in the extension direction of the washware basket and decreases in the retraction direction. The row or lighting ribbon formed by the light sources thus lengthens in the extension direction and shortens in the retraction direction. It is however also conceivable for the length of the lighting ribbon or the row of light sources to remain the same during the inward or outward movement of the washware basket, but that depending on the progress of the inward or outward movement of the washware basket, the lighting ribbon or the row of lighting sources in its entirety changes color or an illuminated, for example colored, section of the lighting ribbon moves forwards or backwards according to the movement of the washware basket. If appropriate, instead of a multiplicity of light sources arranged in a row, one elongated light source only, such as for example an actively illuminating lighting strip can be provided, which is formed for example by one or more LED or OLED lighting elements.

A row of light sources or a lighting ribbon is preferably arranged in the immediate vicinity of a guide track guiding the washware basket in its retraction and extension direction, i.e. as close as possible to this, so that it emphasizes the insertion level of the respective washware basket or the guide tracks during the retraction and extension of the washware basket. In the case of a washware basket mounted on the side walls of the dishwashing compartment the guide tracks are generally formed by telescopic pullouts, so that the washware basket can be extended sufficiently far out of the dishwashing compartment. A telescopic pullout is not required in the case of a washware basket arranged in the lower part of the dishwashing compartment, as the washware basket can rest on the door or on an inner wall of the door forming its inner face. In this case the washware basket is as a rule provided with under-mounted rollers or sliding elements, which interact with runner surfaces extending in the direction of movement of the washware basket on the inner wall of the door (facing the interior compartment of the dishwashing compartment in the final closure position of the door). Running surfaces are also provided within the dishwashing compartment too, which for example are present on the floor of the dishwashing compartment. A row of light sources or a lighting ribbon is then preferably positioned directly on the runner surface. The light sources are here preferably arranged in inset form, for instance in recesses, so that the rollers or slider elements can largely move along the runner surface unhindered.

The end of a travel movement of the washware basket can then very readily be recognized when the lighting ribbon is of a length corresponding to the displacement distance of the washware basket. The distance traveled by the washware basket is namely then mapped by the lighting ribbon on a near 1:1 basis. A further advantageous measure enabling recognition of the progress of the outward or inward movement of the washware basket based on the lighting ribbon consists in the control device being so embodied that it activates the multiple light sources arranged in a row in such a way that the change of a parameter of the light sources propagates in the direction of movement of the washware basket. It is here advantageous if the actuation of the multiple light sources takes place in such a way that the parameter propagates at a speed corresponding to the speed of travel of the washware basket.

There are multiple possibilities for the arrangement of light sources in and on the dishwasher. A light source can thus be arranged standing out from the inner face of a side wall facing the treatment area and/or the base wall of the dishwashing compartment and/or on the inner face of the inner wall of the door facing the treatment area of the dishwashing compartment in the final closure position of the door. Alternatively to such a mode of mounting, in which the light source stands out from the respective wall, an opening or a recess to accommodate the light source can also be present in the aforementioned walls. However one preferable variant provides for the case of an arrangement of one or more light sources on the door, in that at least a partial area of the inner wall of the door, preferably the entire inner wall of the door, is embodied in translucent form, that is consists of one or more translucent materials. One or more light sources are then arranged in one or more recesses or openings in the door covered by the translucent partial area or by the totally translucent inner wall of the door. One or more light sources can thus expediently be arranged in one or more recesses or openings behind a translucent cover element for example made of a glass and/or plastic material, which forms a partial surface area of the inner wall of the door which is otherwise formed of an opaque material such as metal, in particular stainless steel. In particular in the case of a completely translucently embodied inner wall of the door, light sources can be arranged within the interior of the door underneath the inner wall of the door which faces the treatment area of the dishwashing compartment in the final closure position of the door, without a gap thereby arising between light source and inner wall of the door, which would run the risk of rinsing liquid finding its way into the door during operation of the dishwasher. In the case of a translucent inner wall of the door or a partial area thereof, in addition to light sources located in the specified recess, structural parts of the door would also be visible. In order to prevent visibility of the structural parts, in the case of a preferable embodiment it is expediently provided that the partial area or the inner wall of the door (interior door) is provided externally or internally with a coating which has lower translucency than the material forming the partial area or the inner wall of the door. An area located over the light source or sources remains uncoated however, so that a window is created through which the light from the light sources can emerge to the outside.

If within the framework of the explanations of the invention and its advantageous embodiments the expression "capable of extension and retraction" is used in relation to the respective washware baskets, this then comprises a multiplicity of possibilities regarding movement of the respective washware basket into and out of the interior compartment, i.e. the treatment area of the dishwashing compartment.

Other advantageous developments of the invention are specified in the subsidiary claims.

The advantageous embodiments and developments of the invention previously explained and/or specified in the subsidiary claims can here—except for example in the case of clear dependencies or incompatible alternatives—be employed not just individually but also in any desired combination.

The invention and its advantageous embodiments and developments and their advantages are explained in greater detail below on the basis of drawings.

BRIEF DESCRIPTION OF THE DRAWINGS

Wherein, in each case in a schematic diagram.

DETAILED DESCRIPTION OF EXEMPLARY EMBODIMENTS OF THE PRESENT INVENTION

Figure 1:
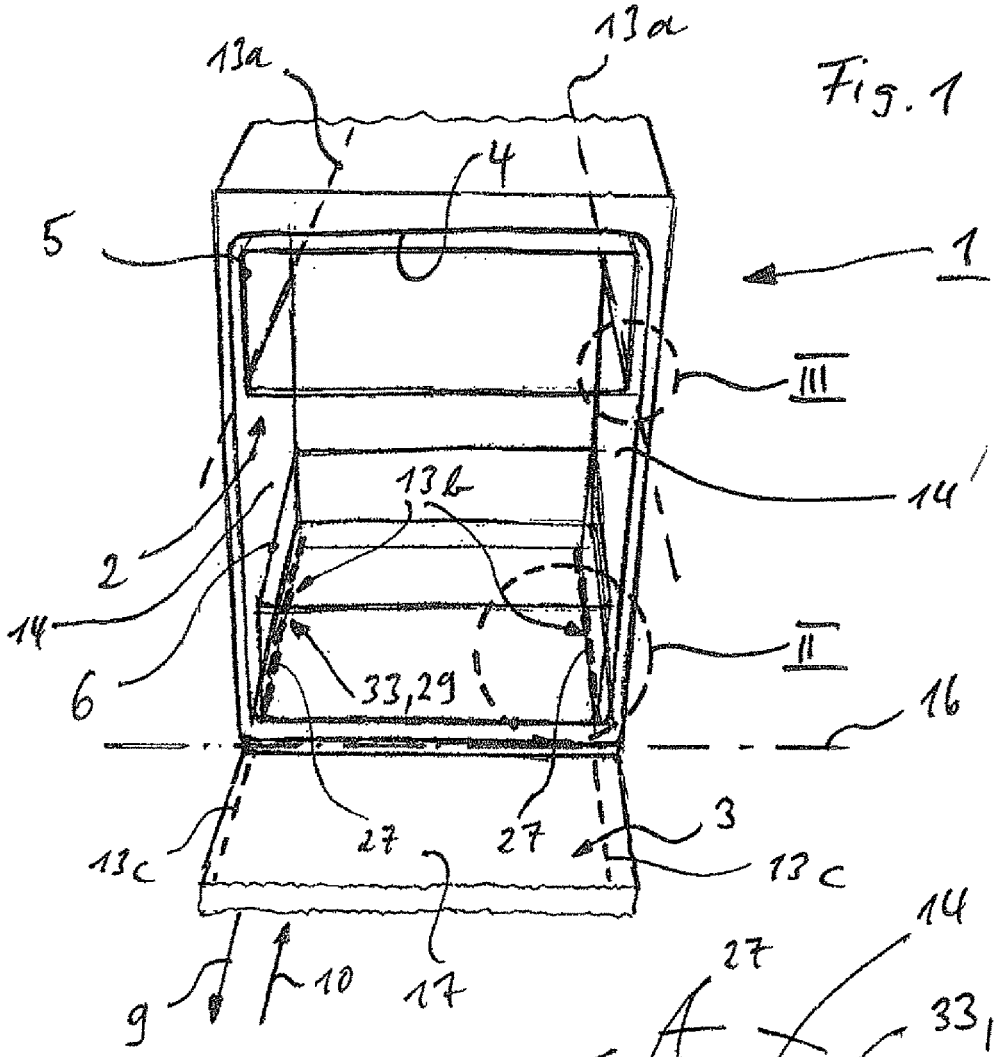
FIG. 1 shows an exemplary embodiment of a dishwasher constructed according to the invention with an open door, represented in three-dimensional form.
Figure 4:
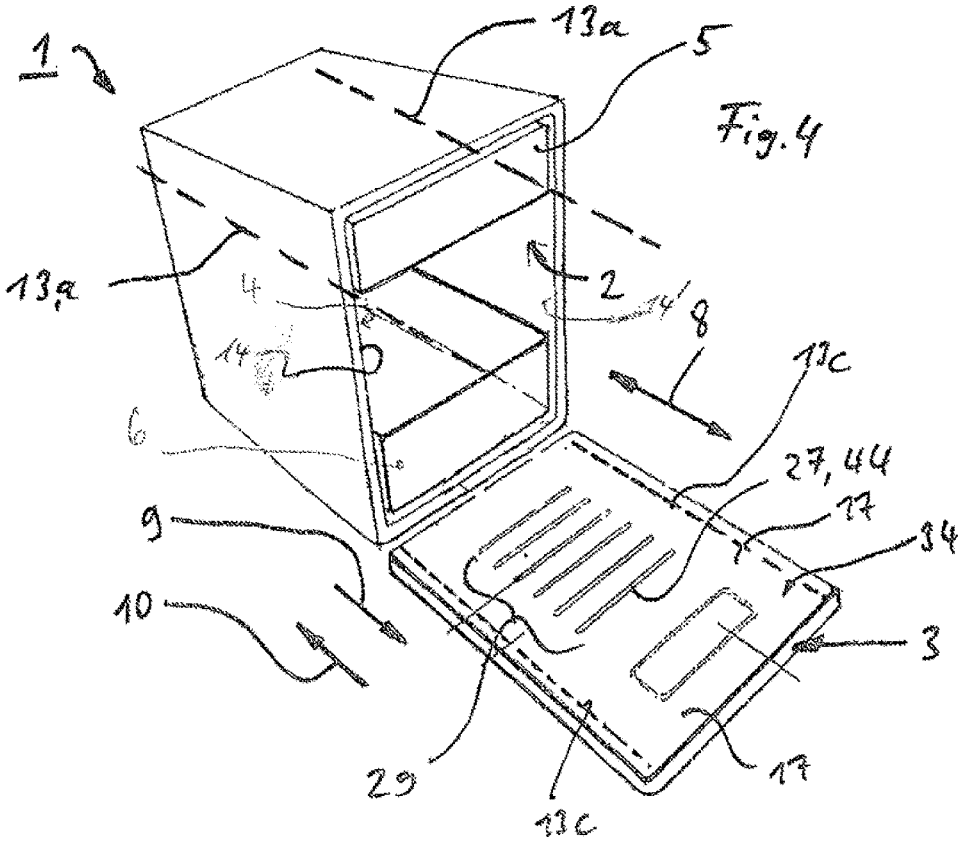
FIG. 4 shows an alternatively embodied dishwasher in a representation corresponding to FIG. 1.
Figures 5, 6, 7:
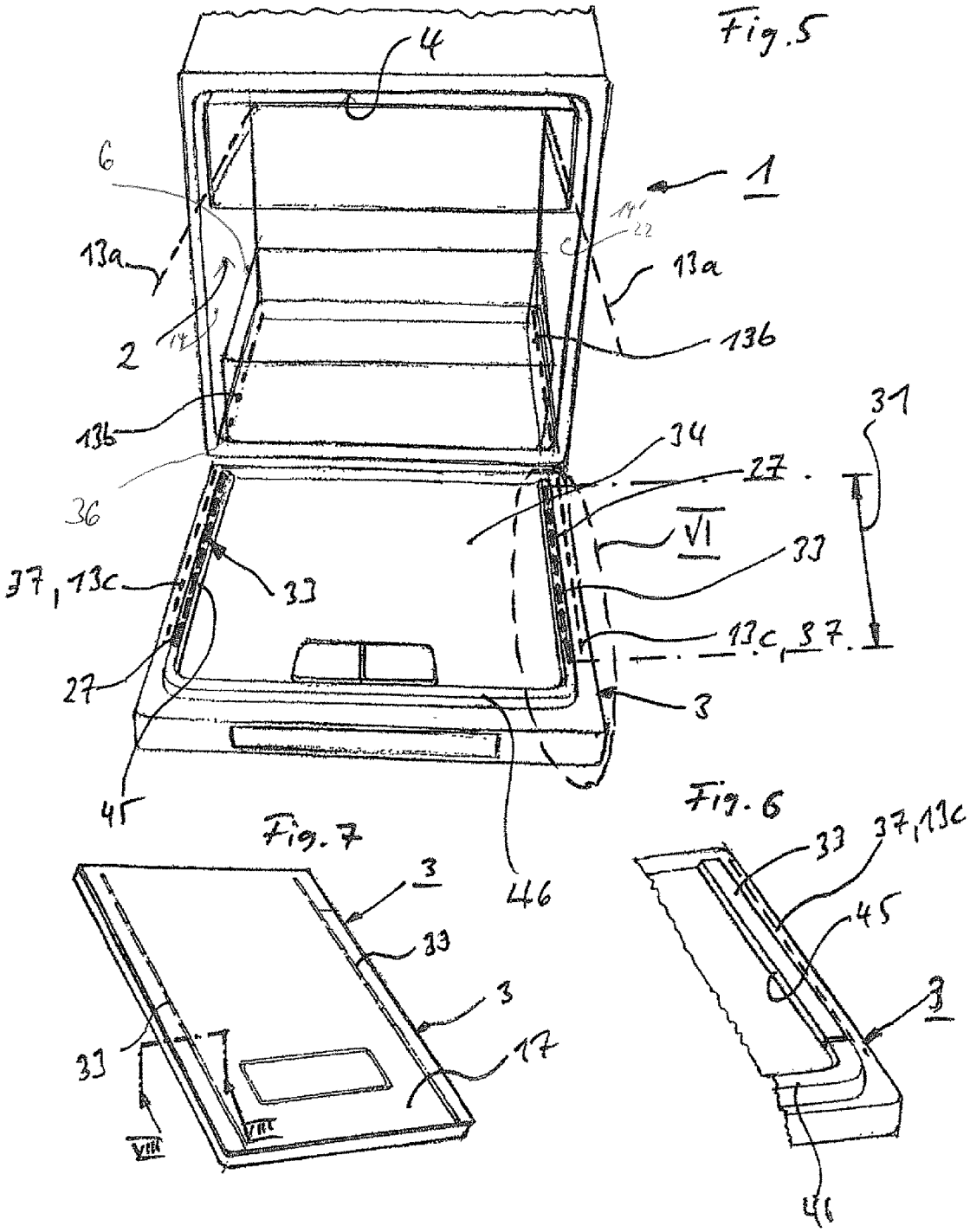
FIG. 5 shows a further advantageous exemplary embodiment of a dishwasher in a representation corresponding to FIG. 1.
FIG. 6 shows the section VI in FIG. 5.
FIG. 7 shows a door of a dishwasher with an embodiment at variance from FIGS. 4 and 5.

A dishwasher 1 shown in its entirety in FIGS. 1, 4 and 5 comprises a dishwashing compartment 2, which preferably has a frontal, loading opening 4 which can be closed by a door 3. The dishwasher 1 further comprises multiple washware baskets for washware such as crockery and cutlery, wherein in the illustrations dishwashers 1 with two washware baskets, specifically an upper washware basket 5 and a lower washware basket 6, are represented by way of example. The washware baskets 5, 6 are retained so as to be slidable in an essentially horizontal direction of movement 8 and can be moved in an extension direction 9 out of the dishwashing compartment 2 and in a retraction direction 10 into the dishwashing compartment 2. The washware baskets 5, 6 are here guided on guide tracks, which extend in direction of movement 8. The upper washware basket 5 is guided on two lateral guide tracks 13a, arranged on the side walls 14, 14' of the dishwashing compartment 2, which are indicated in FIGS. 1, 4 and 5 by dashed lines. The two guide tracks 13*a*, of which one is arranged on one side wall 14 and the other on the opposite side wall 14' of the dishwashing compartment 2, are, for example, formed by telescopic pullouts (not shown), so that the upper washware basket 5 can be extended and in particular can be moved almost completely out of the dishwashing compartment 2. In the case of the lower washware basket 6, such telescopic pullouts are not required due to the door 3, which is mounted in a lower area of the dishwasher 1, pivotable about a horizontal axis 16 and in its open state essentially horizontally oriented. A guide track 13*b* in each case present on the side walls 14, 14' of the dishwashing compartment 2 continues as guide track 13*c* running in the direction of movement 8 on an internal wall surface, i.e. the inner face 17 of the door 3, which in the final closure position of the door is assigned to the treatment area of the dishwashing compartment. In FIGS. 4 and 5 the guide tracks 13*b* and 13*c* are likewise represented by dashed lines. They run along the two lateral peripheral zones of the door, approximately parallel to its longitudinal sides, which extend in the depth direction of the dishwasher in the approximately horizontal final open position of the door.

Figure 3:
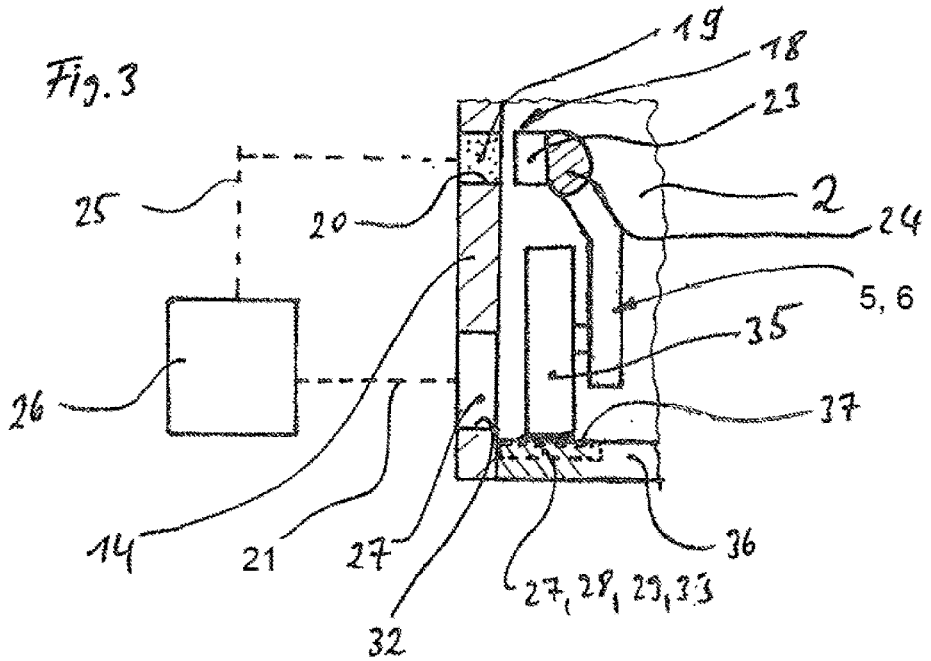
FIG. 3 shows section III from FIG. 1 in cutaway form.

The dishwasher 1 further has an in particular non-contacting, device 18 for the recognition of at least one, preferably a multiplicity of movement positions of the washware baskets 5, 6, which in FIG. 3 is shown in exemplary form for the case of a lower washware basket 6. A multiplicity of possible embodiments is available for a device 18 of the type cited. It can, for example, take the form of an inductively or capacitively operating device. For example a device 19 is provided which operates on the basis of the Hall Effect. It accordingly comprises a Hall sensor 19, which is arranged on the inner face of a side wall 14, 14' or is set into a recess 20 of a side wall. The device 18 further comprises at least one magnet, preferably however multiple magnets 23 distributed over the depth dimension of the washware baskets 5, 6. The magnets 23 are affixed laterally to the washware baskets 5, 6, for example on a basket wire 24 extending in the direction of movement 8 in such a way that upon movement of the basket they come into the area of effectiveness of the Hall sensor 19. It is also conceivable the just one magnet 23 is present on the washware baskets 5, 6, but multiple Hall sensors 19 or multiple Hall sensors and multiple magnets 23 distributed along a guide track 13 are present. The Hall sensor or sensors 19 are connected via a signal line 25 to a control device 26, with which a parameter of at least one light source 27 arranged outside the washware baskets 5, 6 in and/or on the dishwasher can be varied depending on the respective movement position of a washware basket. As regards the light sources it should in general be mentioned that these are represented in highly simplified form in the drawings, and that lighting elements should be understood to possibly encompass the one or more means of illumination such as LEDs and where applicable further components such as housings and optical elements.

For the actuation of one, preferably multiple light sources 27, these are connected to the control device 26 via one or more control lines 21 (in FIG. 3 just one control line is shown on grounds of simplification). Control devices which can be used for the control task in question are sufficiently well known that remarks on the embodiment are at this point superfluous. For example a control device generally present in dishwashers, with which program sequences, etc. can be controlled, i.e. directed, can be used for the purpose specified, if applicable after corresponding adaptation. Based on the embodiment described, light sources 27 can be controlled in such a way that a parameter of the light sources changes depending on the movement position of a washware basket, for example the operating status (on, off), the illuminance, and/or the color of the light. It is thus for instance conceivable that at a location outside the washware baskets which is visible in the case of door 3 being open and at which one or more light sources 27 are positioned, their illuminance increases with the increasing path of travel for example in extension direction 9. On the basis of the illuminance the user thus recognizes the progress of the extension or retraction movement and in particular the respective final positions of a washware basket 5, 6. For example the outer final position, i.e. the fully extended status of a washware basket, is reached when the maximum illuminance prevails. Conversely, the inner final position, i.e. the fully retracted status of the washware basket, is recognized in that no further light source is illuminated. The risk described above that crockery is dislodged in the case of a washware basket coming to rest in its final position with excessive force, and is in certain circumstance damaged, can thereby at least be reduced. Another possible means of indicating the status of travel of a washware basket consists in the color of the light sources changing instead of or in addition to the illuminance. This may for instance be effected by a light source comprising multiple lighting means such as LEDs of different colors, wherein different lighting colors can be created through the activation of individual or multiple lighting means, for example by means of color mixing. Finally, the number of light sources 27 actuated by the control device can even be varied or changed.

Figure 2:
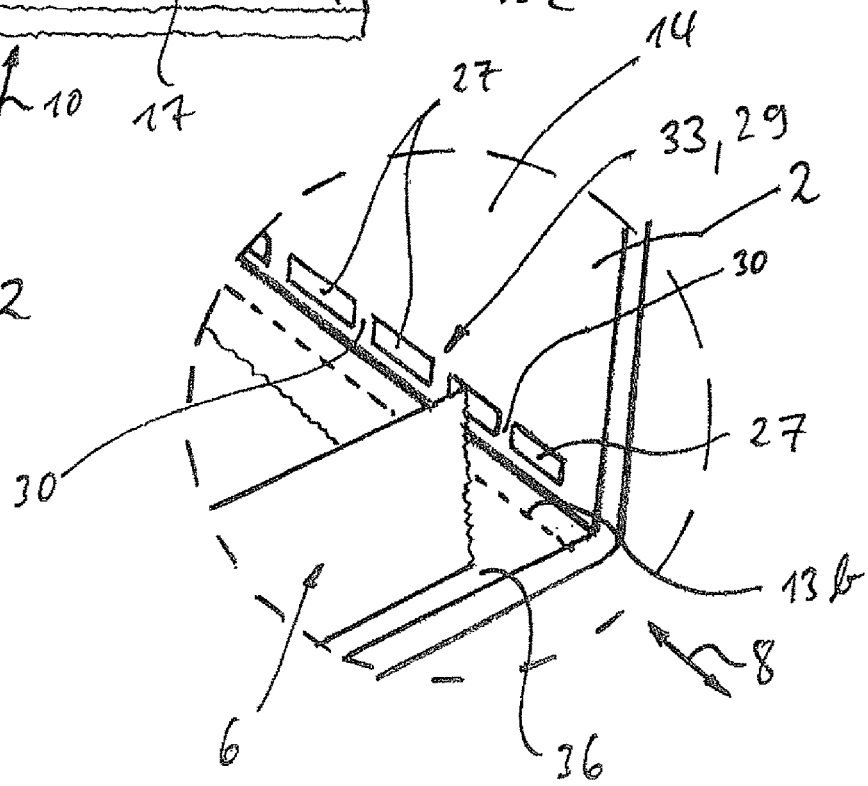
FIG. 2 shows section II in FIG. 1.

A further advantageous possible embodiment provides that multiple light sources 27, as for example shown in FIG. 4, can be embodied in the form of bands 44 extending transversely to the direction of movement 8, arranged in a row 29 extending in the direction of movement 8. If the gaps 30 (FIG. 2) between the light sources 27 are relatively small or there is no gap between them, a strip light or lighting ribbon 33 is created extending in the direction of movement 8. The rows 29 or lighting ribbons 33 are arranged on the side walls 14, 14' of the dishwashing compartment 2 facing the treatment area of the dishwashing compartment or on the inner face 17 of an inner wall of the door 34 covering the inside of the door 3 which faces the treatment area with the door fully closed. A row 29 of light sources 27 or a lighting ribbon 33 can for example be activated by the control device 26 in such a way that the number of illuminated light sources 27 increases in the extension direction 9 of the washware baskets 5, 6 and decreases in the retraction direction 10. A user can then also recognize the respective status of travel of a washware basket 5, 6 and in particular also the final position in the completely extended or completely retracted position respectively on the basis of the length of the illuminated strip light or lighting ribbons 33 or on the basis of the length of a row 29 of light sources. It is here expedient if a strip light or lighting ribbon 33 or a row of light sources is of a length 31 (FIG. 5), which corresponds to the maximum possible distance of travel of the washware basket 5, 6.

In order clearly to emphasize the levels of travel of the washware baskets 5, 6 a lighting ribbon 33 is arranged in the immediate vicinity of a guide track 13 on a side wall 14, 14' or on the inner face 17 of the door 3. In the case of the lower washware basket 6 this is not guided on a telescopic pullout, but rollers 35 or similar guide elements are present on the washware basket 6, which interact with a runner surface 37 arranged on the inner face 17 of the door 3 and on the floor 36 of the dishwashing compartment 2. FIG. 3 shows such a runner surface 37, which is formed by a lateral strip of the floor 36 of the dishwashing compartment 2. A runner surface 37, for example the runner surface shown in FIG. 3, can be provided with one or more light sources 27, which are arranged in the form of a row 29 extending in the direction of movement 8 or a strip light or lighting ribbon 33.

Figure 8:
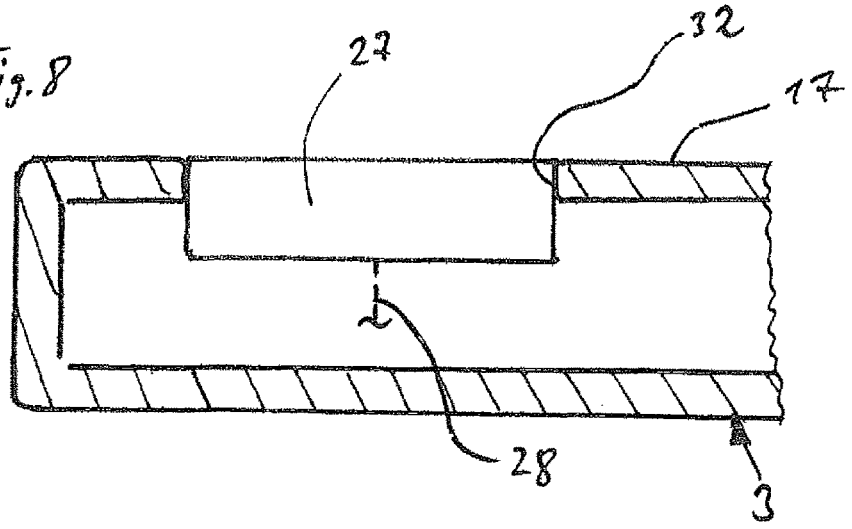
FIG. 8 shows a section through a peripheral area of the door from FIG. 7 corresponding to the line VIII-VIII.

A light source 27 can in principle be mounted on the surface of a side wall 14 or on the surface of the inner wall of the door 34, wherein it stands out from this (not shown). A light source 27 is however preferably arranged in a recess or in an opening 32 of the respective wall, as shown for instance in FIG. 3 and FIG. 8, so that it is largely flush with the surface of the wall.

Figure 9:
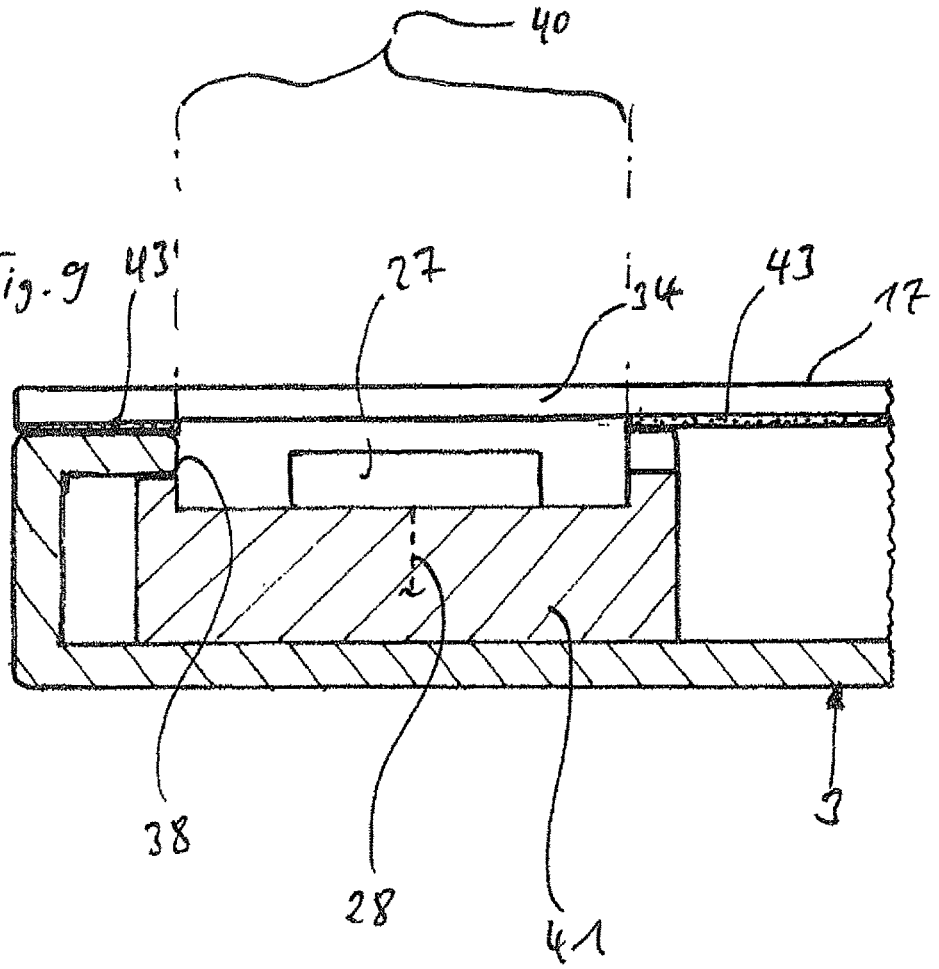
FIG. 9 shows a representation of the peripheral area of an alternatively embodied door corresponding to FIG. 8.
Figure 10:
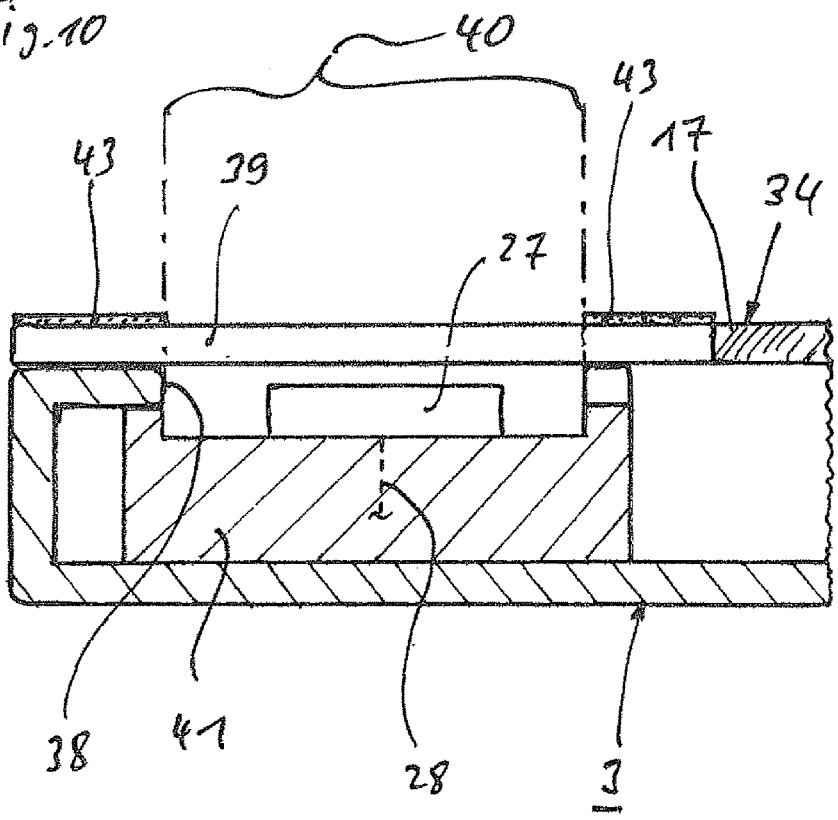
FIG. 10 shows a representation of the peripheral area of a door altered by comparison with FIG. 9 corresponding to FIG. 8.

In the case of a door 3 a further possibility for the arrangement of light sources emerges. Here, the light sources 27 can be arranged in a recess 38 of the door and if applicable retained by a bearer 41, wherein the recess 38 is covered by the inner wall of the door 34 formed of one or more translucent materials (FIG. 9). The light sources 27 thus sit within the interior of the door behind the translucent inner wall of the door 34. It is also conceivable that a partial area 39 of the inner wall of the door 34 is translucent (FIG. 10). In both cases it is expedient if the partial area 39 or the entire inner wall of the door 34 is provided on the inside (FIG. 9) or the outside (FIG. 10) with a coating 43, leaving free a window 40 which has a lower translucency than the translucent inner wall of the door 34 or a material forming a translucent partial area 39 thereof.

In the case of the dishwasher from FIG. 1, whose door in its final open position is oriented approximately horizontally, the inner wall of the door 34 has two raised projecting peripheral webs 45 extending in the direction of movement 8 of the respective washware basket 5, 6 (which here runs approximately parallel to the depth dimension of the dishwashing compartment), which are connected to each other by means of a similarly formed connecting web 46 close to the upper edge of the door 3. A lighting ribbon 33 is arranged on or in the top of the peripheral webs 45, wherein the lighting ribbons 33 or the peripheral webs 45 which carry them are each flanked externally by a guide track 13*c*, embodied as a runner surface 37.

In the exemplary embodiment of FIG. 7 light bands 33 likewise extend in direction of movement 8, wherein the light bands 33 are set into the inner face 17 of the door 13 or, arranged as shown in FIG. 9 and FIG. 10. The lighting ribbons 33 here extend within the runner surfaces 37, with which the lower washware basket 6, for example, interacts via rollers 35.

It can in particular be expedient if strip lights or lighting ribbons or rows of multiple illumination or light sources are provided both in the area of the floor 36 of the dishwashing compartment 2 as well of the inner face 17 of the inner wall of the door 34, in particular in the area of the two guide tracks 13*b* and 13*c* of the lower washware basket, for example 6, which traverse its rollers 35 upon its movement into or out of the dishwashing compartment. The entire possible path of travel of the lower washware basket can thereby be made optically recognizable to the respective user.

Here, the light sources can expediently be provided either on top of the floor 36 and/or on top of the inner face 17 of the inner wall of the door 34, or in recesses or openings of the floor 36 and/or of the inner wall of the door 34. Here, the recesses or openings can in each case expediently be provided with a translucent top cover. This translucent cover is preferably largely arranged to be flush with the opaque areas of the floor and/or of the inner wall of the door surrounding the respective recess or opening. Perfect, liquid-tight integration of the one or more light sources into the floor of the dishwashing compartment and/or in the inner wall of the door is thereby provided. If appropriate, the one or more light sources can also be arranged underneath the floor of the dishwashing compartment and/or underneath the inner wall of the door facing the interior compartment of the dishwashing compartment (in the final closure position of the door), if the entire inner wall of the floor of the dishwashing compartments and/or the entire inner wall of the door in each case consist in particular of a translucent material.

LEDs or OLEDs in particular, but also other illumination or lighting means can be used as light sources for the various design engineering variants illustrated above, provided that at least one parameter of the respective illumination or lighting means such as its time of activation and/or deactivation, illuminance, brightness, color, timing, . . . etc. can be controlled, i.e. influenced and changed, by means of a conventional control device.

The invention claimed is:

1. A dishwasher, comprising:

a dishwashing compartment having a loading opening;

a door configured to close the loading opening;

at least one washware basket configured for movement out of and into the dishwashing compartment;

a device configured for recognition of at least one movement position of the at least one washware basket;

at least one light source arranged in or on the dishwasher; and a control device configured to control the at least one light source in dependence on the at least one movement position of the at least one washware basket, wherein the at least one light source has an elongated configuration or the dishwasher comprises a multiplicity of said at least one light source arranged in a row, said control device being configured to activate the at least one light source of elongated configuration or the row of light sources, such that a change of a parameter of the at least one light source of elongated configuration or of the row of light sources propagates in a direction of movement of at least one washable basket.

2. The dishwasher of claim 1, constructed in the form of a domestic dishwasher.

3. The dishwasher of claim 1, wherein the loading opening is a frontal loading opening.

4. The dishwasher of claim 1, wherein the device is configured for non-contacting operation.

5. The dishwasher of claim 1, wherein the at least one light source is provided in the dishwashing compartment at a location outside the at least one washware basket.

6. The dishwasher of claim 1, wherein the dishwashing compartment has a floor and side walls, said at least one light source being provided in one of three ways, a first way in which the at least one light source is provided in or on the floor, a second way in which the at least one light source is provided in or on the side walls, a third way in which the at least one light source is provided in or on an internal wall surface of the door in confronting relation to an interior of the dishwashing compartment, when the door is in a final closure position.

7. The dishwasher of claim 1, wherein the parameter is a member selected from the group consisting of illuminance, color, mode of illumination, time of activation, time of deactivation, and timing.

8. The dishwasher of claim 1, wherein said light source of elongated configuration or said multiplicity of said at least one light source is arranged along a guide track provided for the at least one washware basket in the dishwashing compartment or on an internal wall surface of the door.

9. The dishwasher of claim 8, further comprising a multiplicity of said at least one washware basket to define a lower washware basket, said guide track being provided for the lower washware basket.

10. The dishwasher of claim 8, wherein the guide track has a runner surface, on which the at least one washware basket rests in slidable form.

11. The dishwasher of claim 1, wherein on condition that said at least one light source comprises the multiplicity of said at least one light source, said control device being configured to activate a different number of light sources depending on a path of travel of the at least one washware basket.

12. The dishwasher of claim 11, wherein the control device activates an increasing number of said light sources as the path of travel of the at least one washware basket increases.

13. The dishwasher of claim 11, wherein the control device activates the light sources in such a way that a number of illuminated ones of the light sources increases in an extension direction of the at least one washware basket and decreases in a retraction direction.

14. The dishwasher of claim 11, wherein the multiplicity of light sources are arranged in a row extending in a direction of movement of the at least one washware basket in or on an internal wall surface of the door or of a wall of the dishwashing compartment.

15. The dishwasher of claim 14, wherein the wall is formed by a floor of the dishwashing compartment or a side wall of the dishwashing compartment.

16. The dishwasher of claim 14, wherein the row of light sources is arranged in immediate vicinity of or directly along a guide track, along which the at least one washware basket is guided in an extendable or retractable manner.

17. The dishwasher of claim 16, wherein the guide track has a runner surface, on which the at least one washware basket rests in slidable form, said row of light sources being arranged in immediate vicinity of or directly on the runner surface.

18. The dishwasher of claim 1, wherein a length of the at least one light source of elongated configuration or a length of the row of light sources corresponds to a maximum distance of travel of the at least one washware basket.

19. The dishwasher of claim 1, wherein the at least one light source of elongated configuration or the row of light sources is activated such that the parameter propagates at a speed corresponding to a speed of travel of the at least one washware basket.

20. The dishwasher of claim 1, wherein the at least one light source is provided on an inner face of a side wall or of a floor of the dishwashing compartment or on an inner face of an inner wall of the door which faces an interior of the dishwashing compartment when the door is in the closed position.

21. The dishwasher of claim 1, wherein the dishwashing compartment has a side wall and a floor, said at least one light source being arranged in an opening of the side wall, or in an opening of the floor, or in an opening of an inner wall of the door.

22. The dishwasher of claim 1, wherein the door has a recess which accommodates the at least one light source and is covered by a translucent inner wall of the door or by a translucent partial area of an inner wall of the door.

23. The dishwasher of claim 22, wherein the inner wall of the door or the partial area is provided with a coating, leaving free a window arranged above the at least one light source, said coating having a translucency which is lower than a translucency of a material forming the translucent inner wall of the door or the translucent partial area.

* * * * *